US005101538A

United States Patent [19]

Dieter

[11] Patent Number: 5,101,538

[45] Date of Patent: Apr. 7, 1992

[54] ZIPPER PULL

[76] Inventor: William M. Dieter, 526 NW. 21st Ave., Apt. 24, Portland, Oreg. 97204

[21] Appl. No.: 557,542

[22] Filed: Jul. 24, 1990

[51] Int. Cl.[5] ..... A44B 19/26

[52] U.S. Cl. ..... 24/429; 24/421

[58] Field of Search ..... 24/429, 431, 419, 420, 24/421

[56] References Cited

U.S. PATENT DOCUMENTS

| | | | |
|---|---|---|---|
| 1,480,027 | 1/1924 | Statham . | |
| 1,662,367 | 3/1928 | Draher et al. | 24/429 |
| 1,900,152 | 3/1932 | Bebel . | |
| 2,325,709 | 8/1943 | Samstegman | 24/429 X |
| 2,345,348 | 3/1944 | Marinsky | 24/421 |
| 2,373,523 | 4/1945 | Winterhalter | 24/421 |
| 2,524,574 | 10/1950 | Ryser | 24/421 |
| 3,292,224 | 12/1966 | Silberman | 24/419 |
| 4,165,713 | 8/1979 | Brawner et al. . | |
| 4,918,794 | 4/1990 | Harvey | 24/429 |
| 4,928,363 | 5/1990 | Easton . | |

FOREIGN PATENT DOCUMENTS 186213 7/1956 Austria .

*Primary Examiner*—Laurie K. Cranmer
*Attorney, Agent, or Firm*—Banner, Birch, McKie & Beckett

[57] ABSTRACT

A zipper pull for sliding a slider head of a zipper along locking teeth to selectively engage and separate the teeth includes a resilient loop and a coupling. The coupling defines one end which is fixed to the loop at an angular orientation therewith and another end which is pivotally attached to the slider head. The positioning and resilience of the loop acts to reduce the tendency of a zipper pull to bounce around when a user is enggaged in an activity.

31 Claims, 3 Drawing Sheets

ZIPPER PULL

TECHNICAL FIELD

The present invention pertains to a zipper pull, and in particular, to a zipper pull specially adapted for athletic activities.

BACKGROUND OF THE INVENTION

In general, zipper pulls facilitate easy movement of the slider head used to engage and separate the teeth of a zipper. Typically, a zipper pull is comprised of a planar, generally rectangular hand grip pivotally attached to the slider head. The zipper pull is ordinarily loosely attached to permit easy grasping and movement of the head in either direction and provide a structure adapted for easy and economical manufacture. Known zipper pulls must ordinarily be grasped between a user's thumb and index finger to operate, which is difficult to accomplish when wearing gloves. Gloves are commonly worn, for example, when a user jogs outdoors in a cool climate.

Zippers are commonly used to fasten articles of clothing, such as jackets, sweat suits, etc. However, when an individual wearing the clothing engages in an activity, the zipper pull may bounce against the person. This action can be particularly annoying to one involved in a rhythmic activity, such as jogging. In the past, zippers have been developed with zipper pulls which are frictionally lodged or hooked into engagement with the slider head to prevent its bouncing. An example of such a construction is disclosed in U.S. Pat. No. 1,900,152 to Bebel, entitled "Safety Removable Fastener." This type of construction, though, increases the manufacturing costs, reduces the ease in which the zipper pull is grasped by the user, and is subject to disrepair as the pegs become worn through use.

SUMMARY OF THE INVENTION

In accordance with the present invention, a zipper pull having a unique two-part construction is provided to overcome the aforementioned problems.

More specifically, the zipper pull is comprised of a resilient loop fixed to a coupling. The coupling, in turn, pivotally attaches the zipper pull to the slider head. The loop is angularly oriented with respect to the coupling to apply a biasing force so that the pull ordinarily is urged against the zipper teeth. This arrangement functions to decrease the tendency of the zipper pull to bounce. Further, the resilience of the loop acts to dampen the jarring experienced by the zipper pull during the user's activities.

As can be readily appreciated, the zipper pull of the present invention eliminates the undesirable bouncing experienced by a typical zipper pull of the prior art as well as the annoying clicking noise of metal hitting metal (i.e., the hand grip against the zipper teeth). Moreover, the zipper pull is easily and economically fabricated to facilitate commercial mass production. In addition, the resilient nature of the loop permits the pull to be conveniently grasped and facilitates bending of the loop to positions which ease the pulling of the head. The zipper pull is also durable and not susceptible to premature wear or breakage.

In addition, the loop preferably defines an opening having a diameter sufficient to permit the ingress of a user's finger when wearing gloves. This construction permits the present zipper to be easily operated, even when wearing gloves, by simply hooking a finger into the loop and pulling the head in the desired direction.

These and other objects, advantages, and features of the present invention will be more fully understood and appreciated by reference to the specification and the appended drawings.

DETAILED DESCRIPTION OF THE PREFERRED EMBODIMENT

Figure 1:
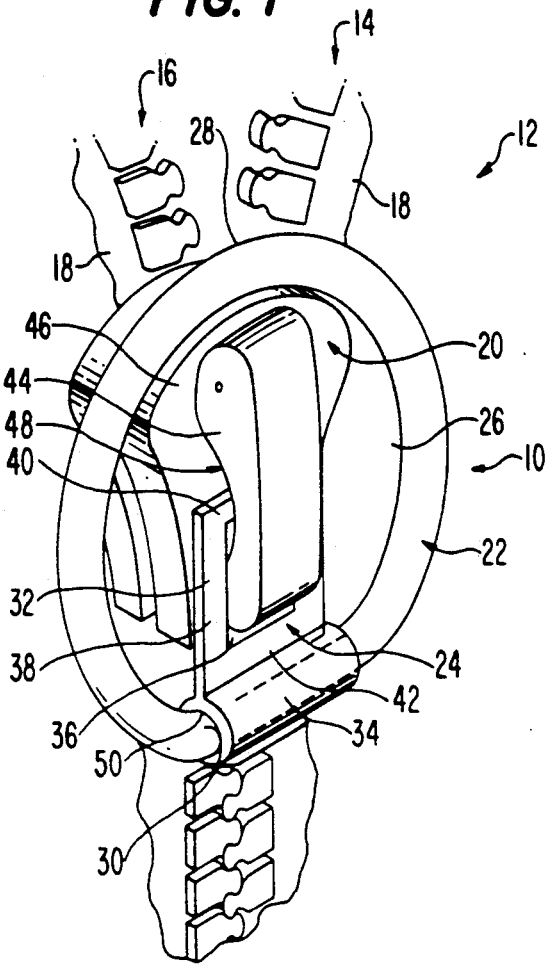
FIG. 1 is a perspective view of a zipper pull of the present invention in its rest position.

In the present invention, a zipper pull 10 is used in conjunction with a zipper 12 (FIGS. 1–4). The zipper is intended primarily for being used in an article of clothing (not shown), although other uses are possible. The zipper includes two series of locking teeth 14, 16 each secured to a fabric strip 18 in a well known manner for attaching the zipper 12 into the clothing. A slideable tab or slider head 20 is also employed to engage and separate the teeth to thereby affect closing and opening of the zipper, respectively, in a well known manner.

Zipper pull 10 is operably connected to head 20 so that the user may easily grasp the pull and manually slide the head along teeth 14, 16 in either direction. More specifically, zipper pull 10 is comprised of a unique two-part construction which includes a loop 22 and a coupling 24.

Figure 9:
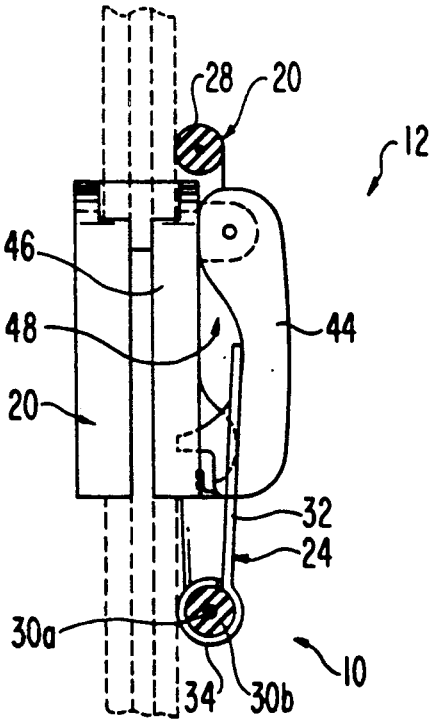
FIG. 9 is a cross-sectional view of a second embodiment of the zipper pull of the present invention.

Loop 22 is preferably a resilient, annular member in the form of a rubber o-ring. Nevertheless, other elastomeric materials, such as various plastics, could also be used, as well as a resilient metallic member **30*a* (which may be coated with plastic or rubber 30*b*) (FIG. 9). Further, although loop 22 is shown as a circular member in the drawings, nearly any geometric shape could be provided. Loop 22 defines an opening 26 through which the user may insert at least one finger in order to grasp pull 10 and move head 20. Loop 22 further includes a free end 28 and an end 30 attached to coupling 24**.

Coupling 24 is generally a planar member having a body 32 and a fixing section 34 at one end. Body 32 is generally rectangular in shape, although other shapes could be used. Further, body 32 includes a central hole 36 which defines a rectangular, marginal edge 38. Marginal edge 38 is comprised in part by first and second opposed legs 40, 42.

Coupling 24 is attached to slider head 20 for free pivotal movement. In particular, head 20, as is common in the prior art, includes a ridge 44 which overlies the main body 46 thereof. Ridge 44 further defines an aperture 48 between itself and body 46. To effect the pivotal attachment of coupling 24 to head 20, first leg 40 of coupling 24 is loosely received into and through aperture 48. In the preferred construction, marginal edge 38 is a closed structure which is received in aperture 48 before ridge 44 is closed over body 46, as is well known in the prior art.

Figure 3:
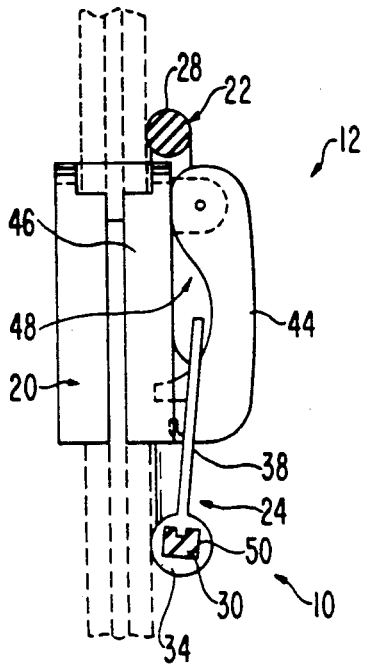
FIG. 3 is a cross-sectional view taken along line 3—3 in FIG. 2.
Figure 2:
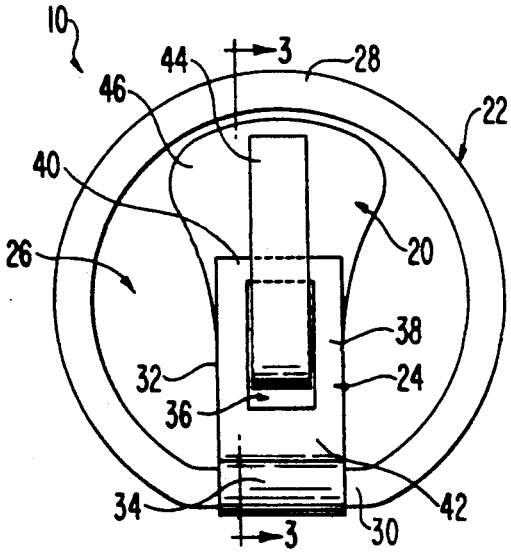
FIG. 2 is a front elevational view thereof.
Figure 4:
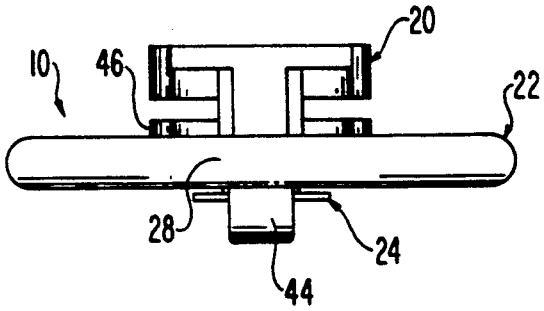
FIG. 4 is a top plan thereof.
Figure 7:
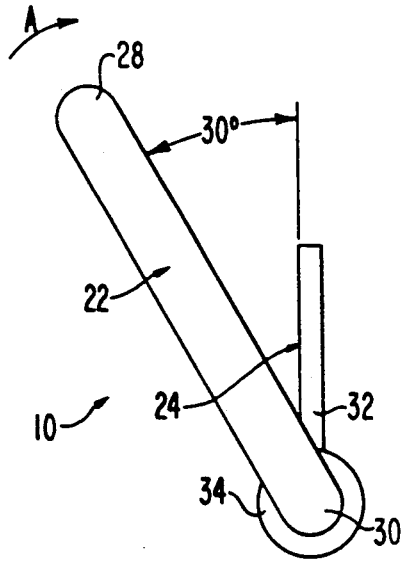
FIG. 7 is a side elevational view of the zipper pull prior to its attachment to the sliding tab.

Fixing section 34 is fixed to second leg 42 of coupling 24. Fixing section 34 defines a small opening 50 through which loop 22 is received. In its fabrication, fixing section 34 is formed as a closed loop of die cast metal. The loop 22 is injection molded through the opening 50 defined therein. As seen in FIG. 3, the interior of opening 50 has a square shape and is provided with a small projection 50*a* which extends into the loop material to additionally ensure that no relative rotation is experienced between coupling 24 and loop 22. Of course, other means of fixedly attaching the components, such as crimping the coupling to the loop, could be used (FIG. 9). Coupling 24 and loop 22 are fixedly oriented so as to form a substantially V-shaped configuration when unattached to zipper 12 (FIG. 7). Preferably, loop 22 is set at an angle of approximately 30° to coupling 24. Nevertheless, this angle could be modified without losing the intended objectives of the invention.

When zipper pull 10 is attached to zipper 12, loop 22 is resiliently bent toward coupling 24 (in the direction indicated by arrow A in FIG. 7) so that the two components are generally coplanar with one another in the rest position (FIGS. 1–4). As can be readily appreciated, loop 22 applies a continual biasing force against the teeth 14, 16, fabric strips 18 and/or the substrate (e.g., a garment) to which the zipper is attached. Also, when the loop is pulled outward for movement of the slider head (as described below), the loop is bent even further from its naturally assuming position (shown in FIG. 7). This further bending draws the loop back to its rest position (FIGS. 1–4) once the head has been moved a desired amount and the zipper pull released.

Figure 5:
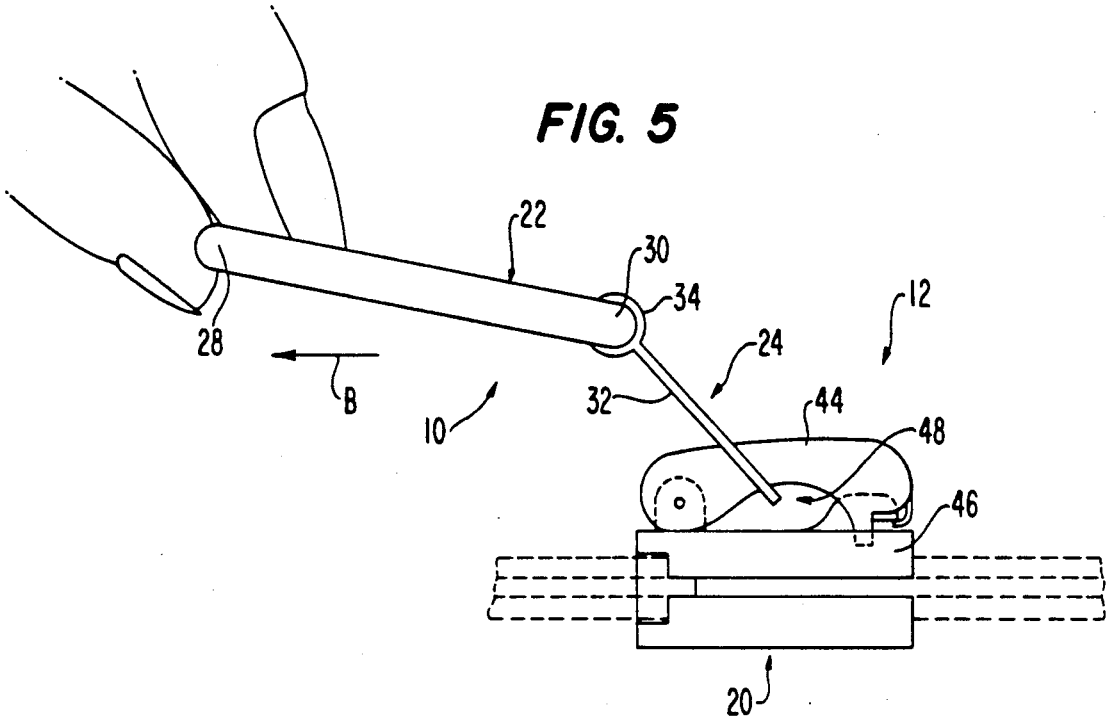
FIG. 5 is a side elevational view of the zipper pull when being pulled upwardly to close the zipper.
Figure 8:
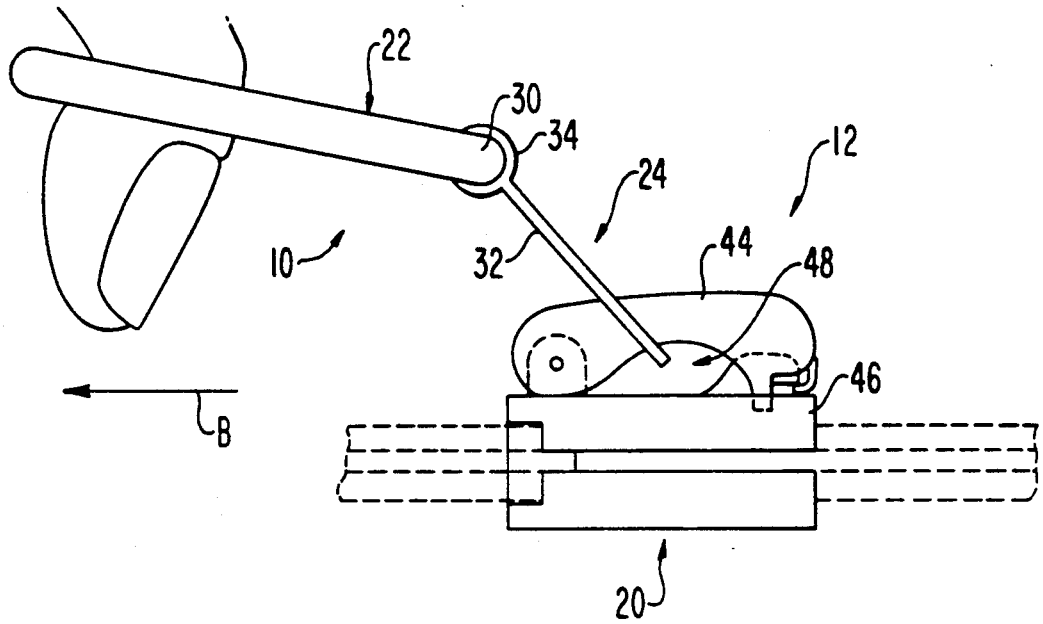
FIG. 8 is a side elevational view of the zipper pull being pulled upwardly via an alternative grasping arrangement.

When the user intends to close the zipper (i.e., move zipper pull 10 and slider head 20 in a direction indicated by arrow B in FIG. 5), loop 22 is grasped and lifted upwardly on a pull 10. Loop 22 can also be grasped by simply inserting one or two fingers into the loop (FIG. 8). The resilient nature of loop 22 permits pull 10 to be easily grasped by the user and lifted away from the zipper teeth 16. This pulling by the user, pivots coupling 24 about head 20 and bends loop 22 into a substantially linear configuration to ease the sliding of the head for the user. However, due to the fixed engagement between loop 22 and coupling 24 the resilient biasing force exerted by the loop 22 is always present. Once the zipper has been closed the desired amount, the user simply lets go of loop 22 and it assumes its rest position (as seen in FIGS. 1–4).

Figure 6:
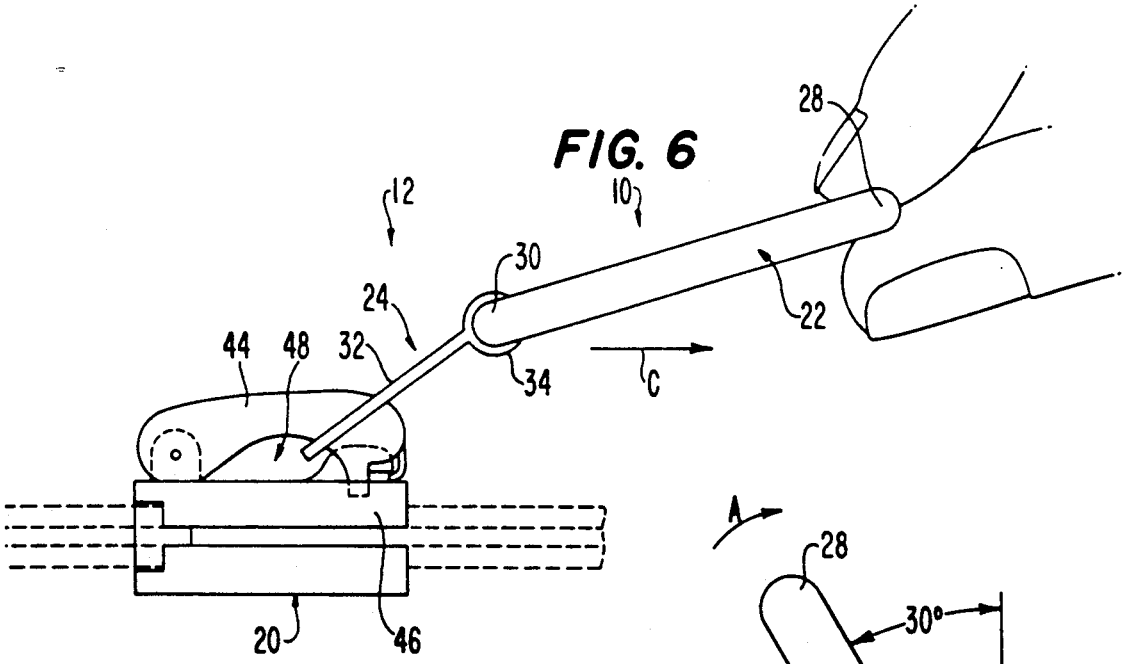
FIG. 6 is a side elevational view of the zipper pull when it is being pulled downwardly to open the zipper.

When a user desires to open the zipper (i.e., move zipper pull 10 and slider head 20 in a direction indicated by arrow C in FIG. 6), loop 22 is grasped and pulled downwardly on pull 10 (FIG. 5). Of course, loop 22 may also be grasped by merely inserting one or two fingers through opening 26. This action, pivotally moves coupling 24 about head 20 and bends loop 22. Loop 22 is bent generally in the same direction as when the zipper pull is moved to close the zipper (FIG. 5). Hence, loop 22 is bent such that it assumes a relatively more linear relationship with coupling 24. As with closing the zipper, once the zipper has been opened to its desired position, the user simply lets go of loop 22 and it naturally assumes its rest position (FIGS. 1–4).

The above description is that of preferred embodiments of the invention. Various alterations and changes can be made without departing from the spirit and broader aspects of the invention as set forth in the appended claims, which are to be interpreted in accordance with the principles of patent law including the doctrine of equivalents.

I claim:

1. A zipper comprising two series of opposed teeth, a slider head slideable along said teeth to alternatively engage and separate said teeth, and a zipper pull, the improvement comprising a zipper pull including:

a coupling pivotally attached to said slider head; and a resilient member fixedly attached to said coupling such that said resilient member resiliently forces and holds itself and said coupling in a generally planar orientation with said slider head in a rest position.

2. A zipper as defined in claim 1, in which said coupling includes a first end pivotally attached to said slider head and a second end fixed to said resilient member and said resilient member includes a free end remote from said second end of said coupling, wherein said free end of said resilient member and said second end of said coupling are at opposite ends of said slider head in said rest position.

3. A zipper as defined in claim 1, in which said coupling includes a first end pivotally attached to said slider head and a second end fixed to said resilient member and said resilient member includes a free end remote from said second end of said coupling, wherein said first end of said coupling is positioned between said second end of said coupling and said free end of said resilient member in said rest position.

4. A zipper as defined in claim 1, in which said resilient member is a loop which encircles said coupling and said slider head in said rest position.

5. A zipper as defined in claim 1, in which said resilient member resiliently bends away from said generally planar relationship with said slider head when grasped and pulled to move said slider head.

6. A zipper as defined in claim 1, in which said resilient member is fixedly attached to said coupling at a selected non-linear orientation so that said resilient member continually biases itself toward said teeth.

7. A zipper as defined in claim 1 in which said resilient member defines an opening of sufficient size to permit a user to insert at least one finger therein, whereby said resilient member can be easily grasped and pulled by a user.

8. A zipper for attachment in a substrate comprising a pair of opposed series of locking teeth, a slider head slideable along said teeth to alternatively engage and separate said teeth, and a zipper pull, the improvement comprising a zipper pull including:

a loop defining a free end and an attached end, said loop being composed of an resilient material; and a coupling pivotally attached to said slider head and fixedly attached to said loop at a selected non-linear orientation so that said loop yieldably presses and holds itself against at least one of said substrate and said teeth in a rest position.

9. A zipper as defined in claim 8, in which said pivotal attachment of said coupling to said slider head is located between said free and attached ends of said loop in said rest position.

10. A zipper as defined in claim 8, in which said loop encircles said slider head and said coupling in said rest position.

11. A zipper as defined in claim 8, in which said loop and said coupling are oriented in a generally planar relationship with each other in said rest position.

12. A zipper for attachment in a substrate comprising a pair of opposed series of teeth, a slider head slideable along said teeth to selectively engage and separate said teeth, and a zipper pull provided to enable a user to grasp and move said slider head, the improvement comprising a zipper pull including:

a coupling moveably coupled to said slider head tab; and a resilient member fixed to said coupling at a selected angular orientation such that said resilient member resiliently holds itself and said coupling in a particular position to substantially prevent said zipper pull from bouncing around when the substrate is moved.

13. A zipper as defined in claim 12, in which said resilient member is resiliently bent out of said selected angular position when in said rest position so that said resilient member engages and presses against at least one of said substrate and said teeth in a direction toward its said angular position.

14. A zipper as defined in claim 13, in which said resilient member and said coupling are in a generally planar orientation with each other in said rest position.

15. A zipper as defined in claim 14, in which said resilient member defines an opening which generally encircles said slider head and said coupling in said rest position.

16. A zipper as defined in claim 12, in which said resilient member defines an opening which generally encircles said slider head and said coupling in a rest position.

17. A zipper as defined in claim 12, in which said resilient member and said coupling are in a generally planar orientation with each other in a rest position.

18. A zipper pull for sliding a slider head in a zipper to selectively engage and separate locking teeth, said zipper pull comprising:

a coupling pivotally attached to the slider head; and a resilient member fixedly attached to said coupling such that said resilient member resiliently forces and holds itself in a generally planar, overlapping relationship with said coupling in a rest position.

19. A zipper pull as defined in claim 18, in which said resilient member is a loop.

20. A zipper pull as defined in claim 18, in which said resilient member defines an opening which generally encircles said coupling when in said rest position.

21. A zipper pull as defined in claim 18, in which said resilient member and said coupling are fixedly attached to each other at a selected non-linear orientation.

22. A zipper pull for sliding a slider head in a zipper to selectively engage and separate locking teeth, said zipper pull comprising:

a loop defining a free end and an attached end, said loop being composed of an elastomeric material; and a coupling pivotally attached to the slider head and fixedly attached to said loop at a selected non-linear orientation so that said loop yieldably presses and holds itself and said coupling in a generally flat orientation adjacent the teeth in a rest position.

23. A zipper pull as defined in claim 22, in which said pivotal attachment of said coupling to the slider head is located between said free end and said attached ends of said loop in said rest position.

24. A zipper pull as defined in claim 22, in which said loop generally encircles said coupling in said rest position.

25. A zipper pull as defined in claim 22, in which said loop is fixedly attached to said coupling at a selected non-linear orientation and oriented in a generally planar relationship with said coupling in said rest position so that said loop continually biases itself toward said non-linear orientation with said coupling.

26. A zipper pull for sliding a slider head in a zipper attached in a substrate to selectively engage and separate locking teeth, said zipper pull comprising:

a coupling moveably coupled to the slider head; and a resilient member fixed to said coupling at a selected angular orientation such that said resilient member resiliently holds itself and said coupling in a particular position to substantially prevent said zipper pull from bouncing around when the substrate is moved.

27. A zipper pull as defined in claim 26, in which said resilient member is resiliently bent out of said selected angular orientation when in a rest position so that said resilient member engages and presses against at least one of the substrate and the teeth when in a rest position in a direction toward its said angular orientation.

28. A zipper pull as defined in claim 27, in which said resilient member and said coupling are in a generally planar orientation with each other in said rest position.

29. A zipper pull as defined in claim 28, in which said resilient member defines an opening which generally encircles said coupling in said rest position.

30. A zipper pull as defined in claim 26, in which said resilient member defines an opening which generally encircles said slider head and said coupling in a rest position.

31. A zipper pull as defined in claim 26, in which said resilient member and said coupling are in a generally planar orientation with each other in a rest position.

* * * * *